US005136815A

United States Patent [19]

Kramarenko et al.

[11] Patent Number: 5,136,815

[45] Date of Patent: Aug. 11, 1992

[54] CONTACTING MECHANISM FOR INSTALLATION FOR ULTRASONIC DIMENSIONAL TREATMENT

[76] Inventors: Boris P. Kramarenko, 7/I, kv. 113, Kharkov, ulitsa Tankopia; Boris Y. Mischenko, 8, kv. 52, Moscow, Lazorevy proezd; Valentin P. Vasjuta, revoljutsii, 23, kv. 5, Kharkov, ulitsa Oktyabrskoi; Valery A. Sokolov, ploschad, 6, kv. 78, Moscow, Tishinskaya; Alexandr P. Yanov, Eidemana, 2, kv. 79, Kharkov, ulitsa Roberta, all of U.S.S.R.

[21] Appl. No.: 637,651

[22] Filed: Jan. 4, 1991

Related U.S. Application Data

[63] Continuation-in-part of Ser. No. 389,161, Aug. 2, 1989, abandoned.

[30] Foreign Application Priority Data

Aug. 3, 1988 [SU] U.S.S.R. ..... 4471286

[51] Int. Cl.[5] ..... B24B 03/46

[52] U.S. Cl. ..... 51/59.55; 51/165 R; 51/45

[58] Field of Search ..... 51/165 R, 165.71, 165.72, 51/165.75, 165.77, 59.55, 45

[56] References Cited

U.S. PATENT DOCUMENTS

| | | | |
|---|---|---|---|
| 2,813,377 | 11/1957 | Duran | 51/59.55 |
| 2,942,383 | 6/1960 | Brown et al. | 51/59.55 |
| 3,561,462 | 2/1971 | Jugler | 51/59.55 |
| 4,512,107 | 4/1985 | Jones | 51/165.71 |
| 4,570,387 | 2/1986 | Unno et al. | 51/165.71 |

*Primary Examiner*—Bruce M. Kisliuk
*Assistant Examiner*—Lawrence Cruz
*Attorney, Agent, or Firm*—Lilling and Lilling

[57] ABSTRACT

A contacting device for an installation for ultrasonic dimensional treatment of workpieces includes a frame having a base; a longitudinal carriage positioned on the frame; a transverse displacement carriage positioned on the base of the frame; an acoustic head electrically coupled with an ultrasonic generator and positioned on the longitudinal displacement carriage, the acoustic head having a tool; a working table positioned on the transverse displacement carriage; a mechanism for controlling vertical feed of the working table to and from the tool; and a mechanism for vertically moving and applying contact force to the working table. The mechanism for vertically moving and applying contact force includes a lever rocker having a roller support mounted on one end of the lever rocker and contacting the working table, and a pressure roller mounted on the other end of the lever rocker so that the roller support lifts the working table and applies contacting force to the working table. The mechanism for controlling vertical feed includes a vertical aerostatic guide affixed to the transverse displacement carriage, an inner member affixed to the working table and disposed inside the vertical aerostatic guide so that the working table is vertically movable, and a mechanism for measuring depth of the took in the workpiece, which includes an electrical contact, having a first blocking contact mounted on the working table and a second blocking contact mounted on a lever which is mounted by one end in a joint and connected by the other end to a drive.

13 Claims, 3 Drawing Sheets

CONTACTING MECHANISM FOR INSTALLATION FOR ULTRASONIC DIMENSIONAL TREATMENT

This is a continuation-in-part of copending application Ser. No. 389,161, filed Aug. 2, 1989, now abandoned.

BACKGROUND OF THE INVENTION

1. Field of the Invention

This invention can be used in mechanical engineering, instrument making and other fields in which hard brittle materials are machined. The invention is designated for ultrasonic dimensional treatment of workpieces of, for example, monocrystals such as celesium, quartz, chromium and germanium, and polycrystals such as ceramics.

2. Description of the Related Art

At modern development of mechanical engineering, high quality and productivity of ultrasonic dimensional treatment (UDT) processes of workpieces can be achieved with usage of special mechanisms (changing mechanisms) for tool displacement relative to the workpiece and also with special service systems which take into account peculiarities of treatment of particular workpieces. Clamping mechanisms are designated for creating a necessary pressure between the tool and the workpiece and also for supporting the tool during a cutting process.

Ultrasonic machines having clamping mechanisms with balancing weights were the first ultrasonic machines to be used in which a clamping force was provided due to a weight difference between an acoustic head and a weight suspended on a flexible band thrown over a pulley system or supported on a lever. Such a system is sometimes used for applying a clamping force between the workpiece and the tool. Change of the force is obtained by replaceable weights or by displacing the weights along a lever. (cf. U.S. Pat. No. 2,580,716, Rosenberg L.D. et al. "Ultrasonic cutting", Moscow, U.S.S.R., Academy of Sciences, 1961, p. 159).

Due to gross inertia and considerable frictional forces of the force transfer system, these and similar ultrasonic machines do not possess sufficient dynamic range of clamping force change and sufficiently small increments, both of which are required for treatment of small workpiece of monocrystal type.

Known in the art are ultrasonic machines manufactured by foreign firms and provided with clamping mechanisms which use balancing springs (cf. Margolin V.S. et al. "Ultrasonic machines" (Survey of foreign structures), ZINTIAM, M. 1963, p. 40). Their advantages are compactness and sufficiently high sensitivity. They are characterized, however, by an unstable clamping force and also by impossibility to regulate the force according to a program and in a wide range.

A number of machines manufactured abroad use a clamp regulator with an electric motor to be periodically switched on (cf. U.S. Pat. No. 2,942,383). The electric motor shifts off, through a worm gearing, the spring balancing the acoustic head, the clamping force being equal to the difference between a head weight and the spring clamping force. Contacts are provided to be moved together with a sliding nut (which is displaced when rotating a screw through the worm gearing). The contacts, when abutting a stop on the acoustic head break an electrical circuit. During the treatment, the acoustic head cuts into the workpiece goes down, and the contacts are opened.

Due to usage of the spring mechanisms, however, the sensitivity is not uniform and is insufficient for practical purposes of crystal treatment.

A more perfect installation scheme was used in the first prototype of the ultrasonic machine model 4772 which was shown on Brussel's exhibition in 1958. An inductance-type transducer was used instead of contacts although the disadvantages for the given treatment remained the same.

Known also in the art are ultrasonic machines with clamping mechanism of the solenoid type (cf. U.S.S.R. Inventor's Certificate No. 114937, and Livshitz A.L. et al. "Universal ultrasonic machine model 4772", "Machines and tools", 1959, No. 6, pp. 10–12) in which the clamping force of these mechanisms is regulated by a rod of a solenoid, a core of which is a counterweight or its slider.

The disadvantage of the machines using the solenoid is low sensitivity and nonlinearity of the force along the whole running path.

Known in the art is the clamping mechanism of the ultrasonic machine with the regulator of the clamping force using an electric motor which operates in a braked mode (cf. U.S.S.R. Inventor's Certificate No. 117882, publ. in 1957). A synchronous servomotor, through a gear reducer and a rack-and-gear drive, actuates a slider supporting the acoustic head. The motor operates in such mode that the motor, being stopped, continues to develop a torque and, therefore, the clamping force which presses a tool to the workpiece (the motor acts as a wound-up spiral spring).

However, due to presence of considerable frictional forces, this clamping system has low sensitivity in respect of the clamping force.

Ultrasonic machine model 46772 is the closest prior art apparatus in respect of the claimed technical essence and the achieved result. In said machine a spindle is balanced by a counterweight and a rocker in such a way that a surplus weight remains of the order 5–6.5 kg (cf. Markov A.I. "Ultrasonic cutting of hard-to-machine materials", Moscow, U.S.S.R., "Mechanical engineering", 1968, pp. 81, 387). The counterweight moves along the rocker which compensates for the surplus weight.

The given machine, however, has low sensitivity of the clamping mechanism and of the setting of the clamping force by reason of considerable frictional forces in the mechanism and inertiality of a mechanical system, narrow range of regulation (about 40:1) stipulated by a structure embodiment and is characterized by complexity of automation of UDT process, and low productivity.

SUMMARY OF THE INVENTION

It is an object of this invention to provide an installation for ultrasonic dimensional treatment of crystals, having feeding and clamping force setting mechanisms which permit an increase in productivity and quality of the treatment of mono- and polycrystals with the usage of tools having a complex form.

This object is obtained in a installation for ultrasonic dimensional treatment of crystals comprising a frame of a portal type, longitudinal and transversal displacement carriages, and acoustic head, an electrical cabinet with an ultrasonic generator and an apparatus of program control to be mounted therein, a working table being kinematically coupled with a lever rocker, the working table being mounted on the carriage of transversal displacement. The carriage of transversal displacement has mounted thereon a vertical aerostatic guide with an aerostatic key to allow working feed of the workpiece by means of lifting the table in a vertical direction. The above installation is provided additionally with an interdependently operating mechanism for setting a clamping or contacting force of a tool of the acoustic head.

Another object of the invention is to make the mechanism for setting the clamping or contacting force in the form of a roller support which contacts a projection of the table and which is mounted on an end of the lever-rocker. On the other side of the lever-rocker is mounted a pressure roller ensuring the necessary clamping or contacting force to be applied by the above roller support to the above projection.

Still another object of the invention is to mount the pressure roller, for regulation of the clamping force, on a transversal lever of a bracket having one end provided with a replaceable weight and another end mounted with opportunity of angular rotation in a joint of a movable carrier being coupled with a gear reducer through a gear rack and gear wheel, the reducer being driven by a step electromotor.

A further object of the invention for increasing the sensitivity to the clamping force is to pivot the lever-rocker on a knive-edge support. For selection of optimum operating conditions the lever-rocker is additionally provided with a calibrating weight on the side opposite to the roller support.

One or more object of the invention is to provide the working table and the feed controlling mechanism with a pair of blocking contacts. In the preferred embodiment, the contacts remain closed until the total and the workpiece touch. Then, step by step and micron by micron the contacts open and close. Cutting occurs only when the contacts are open. When a micron is removed, the contacts again come into contact and an additional increment of force is applied to the working table. One of the contacts may be mounted on a lever, the other to be rigidly coupled with the working table. The lever is pivotally connected with one end to the transversal displacement carriage, while its other end is kinematically coupled with a shaft of a one-step reducer driven by an additional step motor.

It is another object of the invention to provide an electrical connection of the blocking contacts and corresponding step electric motors with an apparatus of program control and corresponding units of digital display indicating the clamping forces and the treatment depths.

It is still another object of the invention to mount a replaceable doser or device for delivering a dose of fluid with a level transducer on a rear side of the portal of the frame, end to mount the acoustic head, coupled with the ultrasonic generator, on a front side of the longitudinal displacement carriage. These elements are electrically coupled with the apparatus of program control, counters of treatment cycles and tool life, and make it possible to check an operator's work and indicate the necessity of replacing an outworn tool.

Lastly, a further object of the invention is to provide for an effective angle and coordinate orientation of a tool on the transversal displacement carriage along one line with an origin of coordinates of the working table at the initial position. To this end, the device preferably has a mechanism of setting displacements and a telecamera or video camera with a set of elongating rings or a magnifying zoom lens which is electrically coupled with the apparatus of program control and a monitor unit to be swivel mounted on a rotary bracket for displaying tool image by the telecamera. The telecamera focuses on the tool and displays the tool image on a monitor having cross-hairs.

The present invention makes it possible to reduce friction to a minimum and increase sensitivity of a pressure roller due, in particular, to providing a lever-rocker on knife-edge support and mounting a working table on aerostatic guides.

Usage of an aerostatic key allows prevention of any rotation of the table around a vertical axis.

Also, the present invention widens functional capabilities of the equipment due to a separation of the table feeding mechanism from the mechanism of setting the clamping or contacting force. New structure of the mechanism of setting the clamping force realizes the opportunity of setting this force in accordance with a program which stipulates the following:

balancing the working table with the installed workpiece and the poured abrasive suspension;

providing the cutting force (of a reduced value);

providing the treatment force (of an optimal value);

providing the force developed by the tool coming out from the workpiece (of a reduced value).

The structure of the replaceable doser and the place of its installation make it possible to use different compositions of working media ensuring herewith the check of liquid presence in the doser and the feeding of even volume doses upon sending instruction from the control system. The doser (the one, for example, of an abrasive paste) is preferably removed from the working area, in which the workpiece may be covered with an abrasive paste, and then liquid may be fed into the working area to form an abrasive suspension and thereby to compensate for (to eliminate) acoustic flows of the suspension from the ultrasonic tool. This reduces the flow-off of the abrasive from the working area to the bath periphery and stabilizes the abrasive concentration in this area thereby increasing the efficiency of treatment.

The present invention allows the discrete lifting of the table when the contacts of the vertical feed controlling mechanism are open and thereby realizes a smooth change of the clamping force when the tool is cutting-in, broaching and coming-out of the workpiece, to obtain high accuracy of orifice treatment in depth (commensurable with the step of vertical feed of the working table).

At last, the usage of the video camera and peculiarity of its mounting, together with the feed controlling mechanism of the working table and the control apparatus, provide in accordance with the present invention, an automatic displacement of the tool from the position of original orientation to the working position (the working table is in the initial position and drops to allow the tool to pass over the walls of the bath).

BRIEF DESCRIPTION OF THE DRAWINGS

The present invention will further be explained by the description of the examples of its particular embodiment and the accompanying drawings, in which.

DESCRIPTION OF THE PREFERRED EMBODIMENTS

Figure 1:
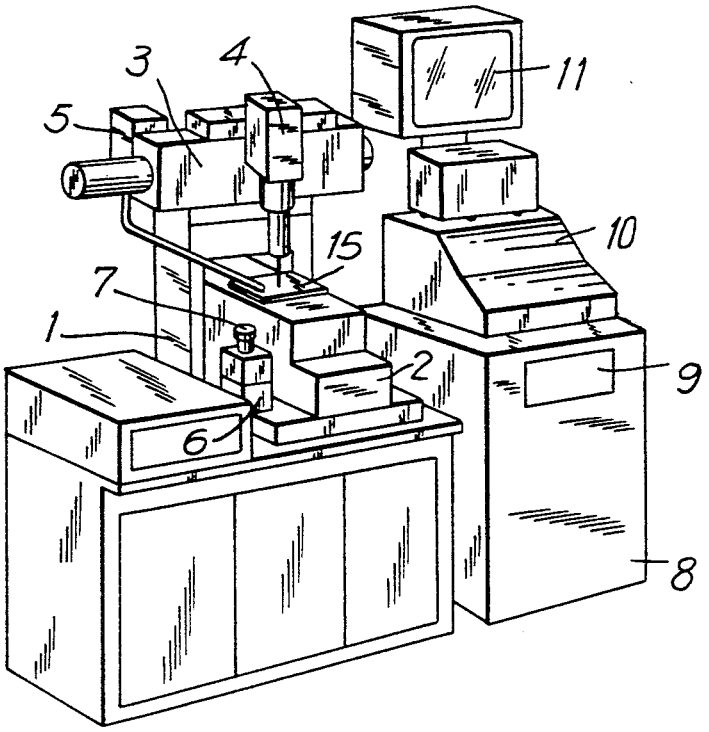
FIG. 1 shows an installation for ultrasonic dimensional treatment of crystals according to the invention.

Referring to the accompanying drawings, an installation for ultrasonic dimensional treatment of crystals comprises a frame 1 of a portal type, a transversal displacement carriage 2 being mounted on the frame 1, a longitudinal displacement carriage 3 being mounted on the portal of the frame. A head 4 of acoustic type is positioned on the longitudinal displacement carriage 3, a replaceable doser 5 is fixed on a rear side of the portal. A mechanism 6 of setting displacements along three coordinates with a video camera or a telecamera 7 and a set of elongating rings or zoom lens (the magnification constitutes e.g. 20–100 x) is provided on the transversal displacement carriage 2 along one axis with the origin of coordinates being coincided with an initial position of a workpiece.

In the right-hand part of the installation an electrical cabinet 8 with an ultrasonic generator 9 is provided on the cabinet is mounted an apparatus of program control 10 with digital indicators of positions of the working table and values of a clamping force. A monitor unit 11 is mounted on a swinging bracket for displaying tool image from the telecamera 7. For convenient operation, a screen of the monitor unit 11 is provided with cross-hair markings.

Figure 2:
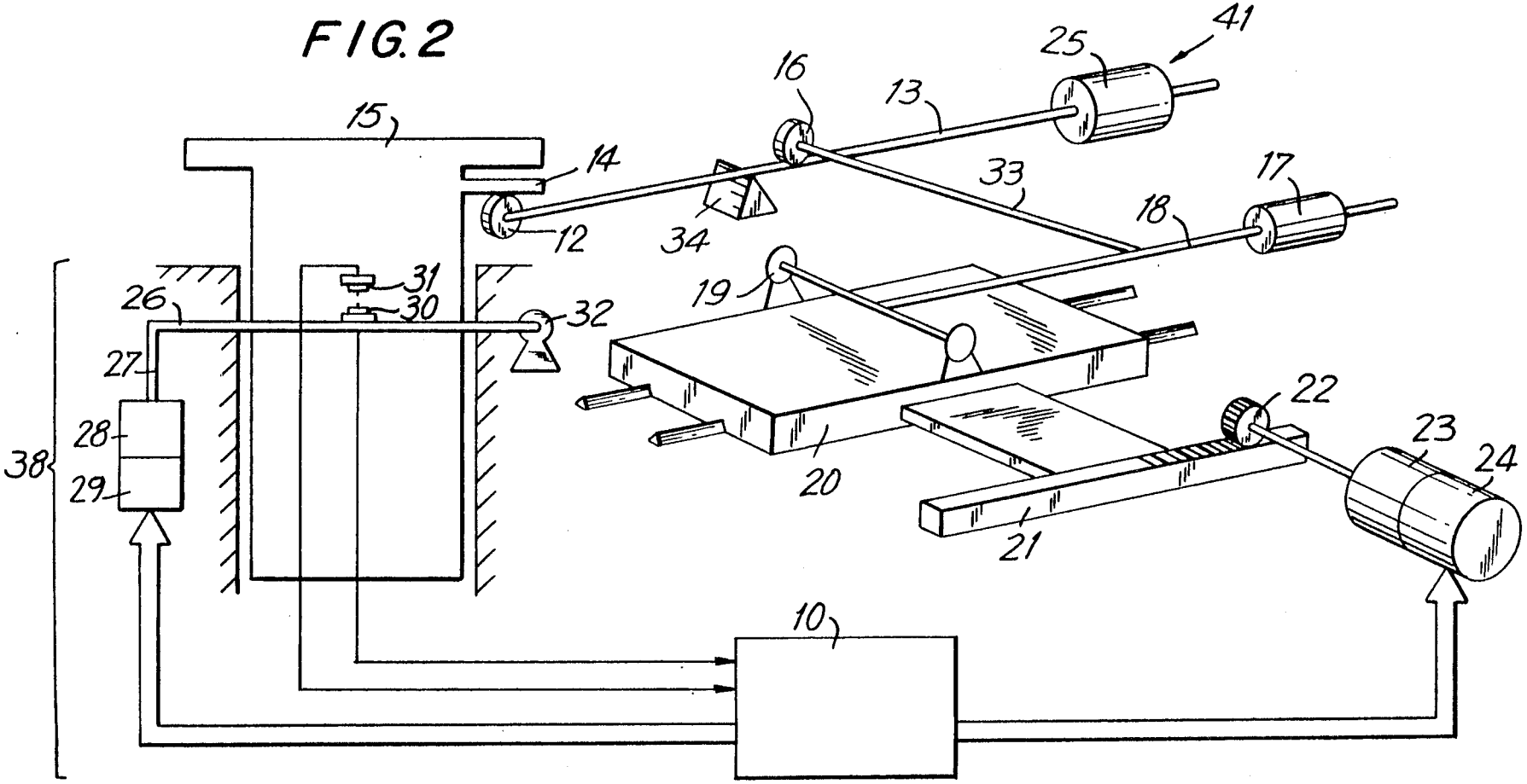
FIG. 2 is a schematic view of mechanisms for controlling feed of the working table and for setting the contacting or clamping force designated for the given installation according to the invention.

The mechanism for setting contacting force 41 (FIGS. 2, 4) provides for the necessary clamping or contacting force of a roller support 12 on a lever rocker 13 to a projection 14 of a working table 15 by means of changing the position of a pressure roller 16 on the lever-rocker 13 and changing the mass of a replaceable weight 17. The replaceable weight 17 (for the force range, e.g. of 30–2500 g, it is recommended to use three replaceable weights) is mounted on a bracket 18 which is fixed at one end in a joint 19 of a movable carrier 20 with the opportunity of rotation in the vertical plane.

The position of the pressure roller 16 is determined by the displacement of the movable carrier 20 being rigidly coupled with a gear rack 21 which is engaged with a gear wheel 22 to be mounted on a shaft of a gear reducer 23 and being driven from a step electromotor 24. For selection of optimum operating conditions a calibrating weight 25 is provided on the lever-rocker 13.

A feeding mechanism of the working table measures and controls its rising by means of a lever 26 abutting the shaft 27 of one-step gear reducer 28 being driven by an additional step motor 29.

The installation for ultrasonic dimensional treatment in accordance with FIGS. 1–4 operates as follows.

A pallet 49 (FIGS. 4) with a small bath and a previously oriented workpiece is mounted on the working table 15.

Herewith, the workpiece may be covered, preferably outside the working area, with abrasive paste which is a mixture of liquid and abrasive in ratio approximately 1:5 to 1:20. Dosers of known structure may be used for feeding the abrasive paste onto the workpiece.

The workpieces 46 with paste are placed in the baths on the pallets 49 with which they are transported to the installation, into the working area. The advantage of this method is that losses due to humidification of abrasive are avoided during transportation.

The liquid is fed into the bath from the doser 5, preferably onto the workpiece 46 with the abrasive paste, at the installation in the working area in quantity necessary for forming suspension. For reducing adverse action (the flow-off or throwing away of abrasive) of the acoustic flows, and improving the conditions for forming the suspension in the acoustic flows, liquid streams are formed to prevent and to compensate for acoustic streams. The liquid streams may be formed preferably by means of flowing compressed air (by feeding it through tubes having perforated walls) into a cutting area (not shown in the drawings). Hereby the productivity and quality of the treatment is increased due to elimination of abrasive losses and due to stable concentration of abrasive in the working area.

Operating modes of the treatment (values of cutting forces and depths of cutting, broaching, coming-out, life of ultrasonic tools, coordinates of holes to be machined, number of doses of the suspension etc.) are set on a console of the program control apparatus 10. Then a too 44 of the acoustic head 4 is set into the position of orientation in accordance with the program, the telecamera 7 with the monitor unit 11 is switched on and the angle and coordinate orientation of the tool 44 is performed in accordance with the marking on the screen of the monitor unit 11. In accordance with the program the tool 44 comes back furthermore to the initial position and comes out to the coordinates of the first hole, herewith a subsequent operating cycle is initiated.

A workpiece 46 is placed inside the pallet 49 which is affixed to the worktable 15. This workpiece 46 is vertically fed to the tool 44 of the acoustic head 4, the tool 44 remaining stationary. The vertical feed of the workpiece 46 to the tool 44 is controlled by a vertical feed controlling mechanism generally indicated by Reference Numeral 38.

The vertical feed controlling mechanism 38 (FIG. 4) comprises: means for preventing the rotation of the working table 15 about its vertical central axis; an electrical contact 43 having two blocking contacts 30, 31; a vertical aerostatic guide 39 which cooperates with an inner member 40 to allow smooth vertical motion of the working table 15; the step electric motor 29 having the one step gear reducer 28 affixed to the shaft 27; and the lever 26 having one end mounted in a joint 32 for rotation in a vertical plane, and having another end contacting the shaft 27; one blocking contact 30 being mounted on the lever 26, while the other blocking contact 31 is mounted to the working table 15.

The blocking contacts 30, 31 are electrically connected with the control apparatus 10 to allow the control apparatus 10 to respond to opening and closing of the blocking contacts 30, 31 of the electrical contact 43. Based on the opened or closed status of the electrical contact 43, the control apparatus 10 controls both the mechanism for setting clamping or contacting force 41 and the vertical feed controlling mechanism 38. The mechanism 41 applies force through the roller support 12 to the projection 14 of the working table 15 to lift the working table 15 and the workpiece 46 until the workpiece 46 comes into contact with the tool 44.

In the preferred embodiment, when the contact 43 is closed, the control apparatus 10 causes the motor 29 to rotate the shaft 27 to raise the lever 26 and the contact 30 by, e.g., a micron. Because the table 15 with the workpiece 46 is touching the tool 44, the table 15 and its contact 31 do not also rise and the electrical contact 43 opens. When the electrical contact 43 opens, cutting takes place until a micron is removed from the workpiece 46, the table 15 moves upwards, and the electrical contact 43 again closes. This process repeats itself until a pre-programmed desired depth of treatment is reached.

Through such a process, the program control apparatus 10 can measure the depth of cutting in of the tool 44 into the workpiece 46, and can also control the incremental increase of contacting force applied by the roller support 12 to the projection 14 of the working table 15. Thus, the interdependence between the vertical feed mechanism 38 and the mechanism for setting clamping or contacting force 41 allows measurement of the machining depth of the workpiece, and insures the setting of a lower contacting force when the workpiece 46 is drilled into and disengaged from the tool 44.

The operation of the installation is further described as follows.

The control apparatus 10 puts out the corresponding command, and the step electric motor 29 through the reducer 28 and the shaft 27 lifts the lever 26 with the contact 30 until the workpiece 46 is touching the tool 44 (lifting is performed preferably at an increased speed). When touching of the tool 44 and the workpiece 46 takes place, the blocking contacts 30 and 31 of the electrical contact 43 open due to the lift of the lever 26 and its rotation in the joint 32, and a command about such event is sent to control apparatus 10. The control apparatus 10 then sends corresponding command to the step motor 24 which, through the reducer 23, rotates the gear wheel 22 and displaces the gear rack 21, the movable carrier 20, and, through a shaft 33, rotates the roller 16 accordingly. The replaceable weight 17, through a lever system, applies pressure to the projection 14 of the working table 15 until the lever-rocker 13 swinging on the edge support 34 is balanced (initially the working table "is dipped"), thereafter the contacts 30, 31 are closed, and a corresponding command is sent to the control apparatus 10.

The control apparatus 10 then puts out a given number of pulses to the step motor 24, which ensures the displacement of the pressure roller 16 along the lever-rocker 13 by the given distance providing the required clamping or contacting force (the cutting-in force).

Thus a shaping of the hole is initiated, and the treatment takes place discretely (namely, if, for example, the contacts 30, 31 are open, the table 15 is raised by one step, when the speed of the treatment exceeds the feed rate the contacts 30,31 are closed. Otherwise the workpiece 46 on the table 15 abuts the tool 44 and contacts 30,31 are open. At this time, treatment of the hole in the workpiece 46 takes place, the contacts 30,31 again close and the lever 26 is raised by one step, and, so forth the processes repeat themselves).

When deepening the tool 44 up to the depth of the final cutting-in position the command is performed and the motor 24 rotating the gear wheel 22 displaces the pressure roller 16 along the lever-rocker 13 ("the broaching force"). Thus may be performed the broaching and the coming-out of the tool 44 from the workpiece 46 at a reduced force.

The means for preventing rotation of the working table 15 about a vertical central axis thereof may preferably comprise a projection 35 located on the periphery of the inner member 40 which slidably enters a key 36 or groove cut into the inside surface of the vertical aerostatic guide 39.

In one preferred embodiment of the invention (FIG. 4), the working table 15 is fixed to the inner member 40 and the vertical aerostatic guides 39 are fixed to the transverse displacement carriage 2. In this embodiment, when the roller support 12 applies pressure to the projection 14 of the working table 15, the working table 15 along with the inner member 40 are lifted. Note that the table 15 could likewise be affixed to the vertical aerostatic guides 39 and the inner member 40 would then be mounted to the transverse displacement carriage.

It is noted that other variations of the lever 26 and blocking contacts 30,31 are possible without departing from the scope or substance of the claimed invention.

Figure 4:
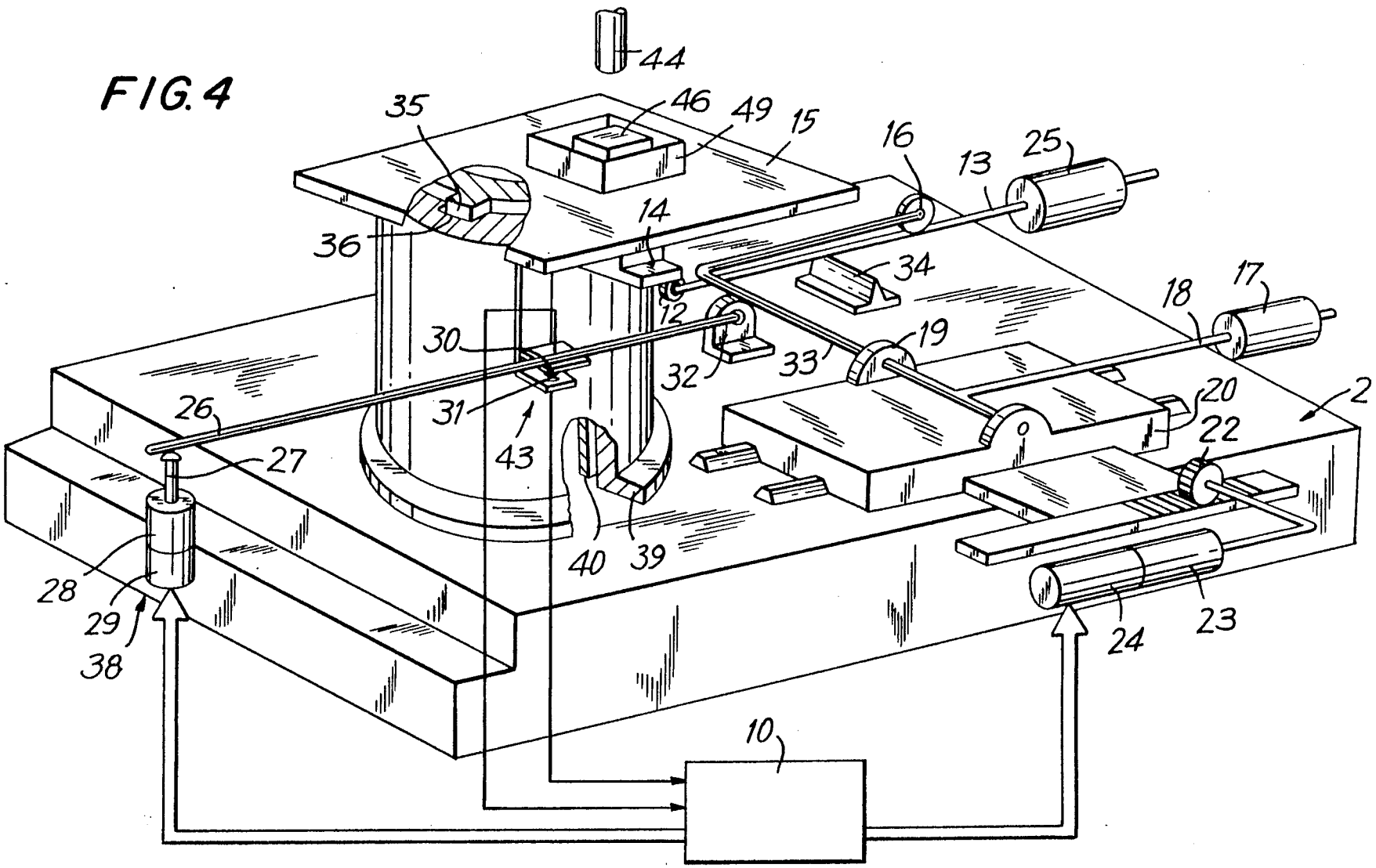
FIG. 4 is a perspective view of a preferred embodiment of the invention.

The blocking contacts 30, 31 are preferably spherically shaped (as shown in FIG. 4) to be concave with respect to each other. With this configuration, slight misalignments of the blocking contacts 30, 31 due to pivoting of the lever 26 and the joint 32 will not prevent the blocking contacts 30, 31 from closing as intended.

To increase the operating efficiency it is recommended to provide the tool with a wear resistant coating only on the periphery of the working part, and not on the whole surface as it is usually practiced since this part undergoes the largest forces in the process of shaping holes. Herewith it is preferable that the double thickness of the coating exceeds the grain size of abrasive but is less than a tolerance zone value by the size of the hole to be treated, and that an end cavity 45 is of an optimum volume containing one layer of abrasive under the tool 44 for providing the effective cutting-in into the workpiece.

Figure 3:
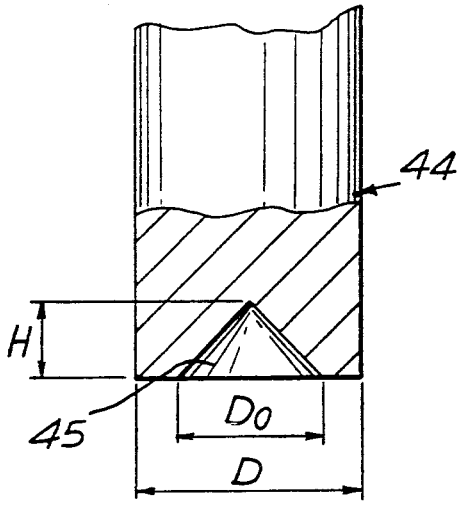
FIG. 3 is an elevational view of a tool, according to the invention.

It is also preferable to provide the end cavity 45 in the form of a cone (as shown in FIG. 3), the base diameter and the height of which are determined by the following relations:

$$Do=0.85D-Ea;$$

$$H=22(5Da)/(D-2.5Ea)$$

and the thickness of the coating constitutes $0.5a<h<0.7a+0.5A$ where: a is the size of abrasive grains (mm); A is the amplitude of oscillations of the too end (mm); D is the diameter of the working part of the tool (mm); E is the coefficient to be equal to (5–12); Do is the diameter of the base of the tool cone (mm); H is the height of the tool cone (mm).

Thus, the double thickness of the coating has an upper limit of the tolerance zone value for the dimension of the hole (usually 60–200 mm), and a lower limit to be determined by the size of abrasive grains.

Consequently, the cavity 45 of the minimum volume preformed in the end of the tool 44 makes it possible to have a minimum of abrasive at the initial instant for the cutting-in, without making the walls of the tool 44 thinner, the even wear of the working part being provided when the wear-resistance of the layer is (for example 1.5–4 times more than the one of the tool.

Upon finishing the cycle of treatment of each hole, counters of cycle number (accumulation) and tool life are put into operation (the value after each cycle is decremented by one down to 0), and when interlocking is activated in the apparatus 10, that is when a change of the instrument is required.

If necessary a change of the replaceable doser 5 is performed or the orientation of a newly installed tool 44 is made.

The present invention may be put into practice in specialized ultrasonic machine-tools having microprocessor control for increasing the productivity of the treatment by approximately 2.5 times as compared with the one of the basic subject-matter and namely the serial ultrasonic machine-tool Model 46772 (U.S.S.R.). The invention, furthermore, increases the accuracy of treatment by approximately 2–3 times, to stabilize the working process with high reproduction of results, and besides, to reduce the share of manual labor by 30–50%.

We claim:

1. An installation for ultrasonic dimensional treatment of workpieces, comprising:

a frame, having a base;

a longitudinal displacement carriage positioned on the frame;

a transverse displacement carriage positioned on the base of the frame;

an acoustic head, electrically coupled with an ultrasonic generator and positioned on the longitudinal displacement carriage, the acoustic head having a tool;

a working table, positioned on the transverse displacement carriage;

means for controlling vertical feed of the working table to and from the tool of the acoustic head; and, means for vertically moving and applying a contact force to the working table.

2. An installation according to claim 1, wherein the means for controlling vertical feeding of the working table comprises:

a vertical aerostatic guide affixed to the transverse displacement carriage;

an inner member, affixed to the working table and disposed inside the vertical aerostatic guide so that the working table is vertically movable;

means for preventing rotation of the working table about a vertical central axis of the working table; and means for measuring a depth of treatment of the tool into the workpiece.

3. An installation for ultrasonic dimensional treatment of workpiece, comprising:

a frame having a base;

a longitudinal displacement carriage positioned on the frame;

a transverse displacement carriage positioned on the base of the frame;

an acoustic head electrically coupled with an ultrasonic generator and positioned on the longitudinal displacement carriage, the acoustic head having a tool;

a working table positioned on the transverse displacement carriage;

means for controlling vertical feed of the working table to and from the tool of the acoustic head; and, means for vertically moving and applying a contact force to the working table, comprising: a lever rocker having a first end and second end; a roller support mounted on the first end of the lever rocker and contacting the working table; and, a pressure roller, mounted on the second end of the lever rocker so that the roller support lifts the working table and applies a contacting force to the working table.

4. An installation according to claim 3, wherein the means for vertically moving and applying a contact force to the working table further comprises:

a bracket having a first end, a second end and a transversal lever, the pressure roller being mounted on the transversal lever;

a replaceable weight, mounted on the first end of the bracket;

a movable carriage having a joint and being mounted on the transverse displacement carriage, the second end of the bracket being mounted for angular rotation in the joint; and, a first drive for moving the movable carriage relative to the transverse displacement carriage, comprising a first step motor, a gear reducer driven by the first step motor, a gear affixed to the gear reducer, and a rack affixed to the movable carrier and cooperating with the gear.

5. An installation according to claim 4, wherein the lever rocker is mounted on a knife edge support.

6. An installation according to claim 5, wherein a calibrating weight is mounted on the second end of the lever rocker.

7. An installation for ultrasonic dimensional treatment of workpieces, comprising:

a frame having a base;

a longitudinal displacement carriage positioned on the frame;

a transverse displacement carriage positioned on the base of the frame;

an acoustic head electrically coupled with an ultrasonic generator and positioned on the longitudinal displacement carriage, the acoustic head having a tool;

a working table positioned on the transverse displacement carriage;

means for vertically moving and applying a contact force to the working table; and means for controlling feed of the working table to and from the tool of the acoustic head comprising a vertical aerostatic guide affixed to the transverse displacement carriage; an inner member affixed to the working table and disposed inside the vertical aerostatic guide so that the working table is vertically movable; means for preventing rotation of the working table about a vertical central axis of the working table; and means for measuring a depth of treatment of the tool into the workpiece comprising an electrical contact having a first blocking contact mounted on the working table and a second blocking contact, and a lever having a first end connected to the transverse displacement carriage through a joint and a second end kinematically connected to a second drive, whereby said second end of said lever can be raised while the first end of said lever pivots in the joint, and said second blocking contact being mounted on said lever.

8. An installation according to claim 7, wherein the lever and the second blocking contact are disposed above the first blocking contact so that the electrical contact closes when the working table moves upwards and opens when the workpiece contacts the tool causing the lever to bring the second blocking contact out of contact with the first blocking contact.

9. An installation according to claim 7, wherein the second drive comprises a second step motor driving a step reducer having a shaft which contacts the second end of the lever.

10. An installation according to claim 9, wherein the means for preventing rotation of the working table comprises a projection on an outer surface of the inner member and a key on an inner surface of the vertical aerostatic guide, the projection fitting into the key to allow vertical motion of the inner member relative to the vertical aerostatic guide and to prevent rotation of the inner member relative to the vertical aerostatic guide.

11. An installation for ultrasonic dimensional treatment of workpieces, comprising:

a frame having a base;

a longitudinal displacement carriage positioned on the frame;

a transverse displacement carriage positioned on the base of the frame;

an acoustic head electrically coupled with an ultrasonic generator and positioned on the longitudinal displacement carriage, the acoustic head having a tool;

a working table positioned on the transverse displacement carriage;

means for controlling feed of the working table to and from the tool of the acoustic head;

means for vertically moving and applying a contact force to the working table; and an apparatus of program control communicating with the means for controlling vertical feeding of the working table and the means for vertically moving and applying a contact force to the working table, whereby the workpiece can be treated incrementally to a desire depth.

12. An installation for ultrasonic dimensional treatment of workpieces, comprising:

a frame having a base;

a longitudinal displacement carriage positioned on the frame;

a transverse displacement carriage positioned on the base of the frame;

an acoustic head electrically coupled with an ultrasonic generator and positioned on the longitudinal displacement carriage;

a tool on said acoustic head and having a cavity and a lateral surface, the lateral surface being coated with a wear-resistant coating having a resistance of 1.5–4 times more wear-resistance than wear-resistance of the rest of the tool;

a working table positioned on the transverse displacement carriage;

means for controlling vertical feed of the working table to and from the tool of the acoustic head; and means for vertically and applying a contact force to the working table.

13. An installation according to claim 12, wherein the cavity of the tool is cone-shaped having a base diameter (Do) and a height (H) determined as follows:

$$Do = 0.85D\text{-}Ea; \text{ and}$$

$$H = (5Da)/(D\text{-}2.5Ea);$$

wherein "a" is a size of abrasive (mm), "A" is an amplitude of oscillations (mm), "D" is a diameter of a working part of the tool (mm), and E is a coefficient equal to 5–12, and further wherein the wear-resistant coating is applied in a thickness falling in the range between 0.5a as a lower limit and (0.7a+0.5A) is an upper limit.

* * * * *